United States Patent [19]

Maruko

[11] Patent Number: 4,766,878

[45] Date of Patent: Aug. 30, 1988

[54] FAR-INFRARED RADIATING SYSTEM

[75] Inventor: Saburo Maruko, Yamato, Japan

[73] Assignee: Nippon Chemical Plant Consultant Co., Ltd., Tokyo, Japan

[21] Appl. No.: 12,391

[22] Filed: Feb. 9, 1987

[30] Foreign Application Priority Data

Feb. 10, 1986 [JP] Japan ..... 61-025990

[51] Int. Cl.[4] ..... F24H 3/00; F24D 5/00; F23Q 11/00

[52] U.S. Cl. ..... 126/116 R; 431/268; 237/50; 237/70; 126/117

[58] Field of Search ..... 126/116 R, 117, 109, 126/91 R, 91 A; 431/326, 328, 268; 237/50, 70

[56] References Cited

U.S. PATENT DOCUMENTS

| | | | |
|---|---|---|---|
| 2,759,472 | 8/1956 | Cartter | 126/91 R |
| 2,946,510 | 7/1960 | Galinn | 237/70 |
| 3,161,227 | 12/1964 | Goss et al. | 431/328 |
| 3,193,263 | 7/1965 | Ruff | 431/268 X |
| 3,251,396 | 5/1966 | Nitsche | 431/328 |
| 3,824,064 | 7/1974 | Bratko | 431/328 |
| 3,922,136 | 11/1975 | Koch | 431/328 X |
| 4,053,279 | 10/1977 | Eichenlaub | 126/85 R X |
| 4,080,150 | 3/1978 | Hunter et al. | 431/268 X |
| 4,533,318 | 8/1985 | Buehl | 431/328 |
| 4,634,373 | 1/1987 | Rattner | 431/328 |

*Primary Examiner*—Larry Jones

*Attorney, Agent, or Firm*—Armstrong, Nikaido, Marmelstein & Kubovcik

[57] ABSTRACT

In a far-infrared radiating system, a plurality of radiating units for allowing the combustion gas to pass therethrough are connected in series to form a multi-stage series-connecting construction. The combustion gas releases its heat energy in the form of far-infrared rays when passing through each of the radiating units. The combustion gas having passed through the radiating unit decreases in temperature, and recovers its previous high temperature through combustion of a fuel which is mixed with such combustion gas before the combustion gas enters the following-stage radiating unit. Such combustion is repeated in each of the following stages so that the heat produced by combustion of the fuel is effectively radiated in the form of the far-infrared rays without making waste.

5 Claims, 3 Drawing Sheets

FAR-INFRARED RADIATING SYSTEM

BACKGROUND OF THE INVENTION

1. Field of the Invention

The present invention relates to a far-infrared radiating system employing a ceramic which radiates far-infrared rays upon heating.

2. Description of the Prior Art

Hitherto, in a conventional type of such far-infrared radiating system, a heat source thereof is provided by an electric heater or a combustion gas produced in a burner or a catalyst unit.

The heat source employing the electric heater is disadvantageous in its operation cost. On the other hand, the heat source employing the combustion gas suffers from a problem that, since only a single-combustion is employed in producing the combustion gas, the combustion gas having heated the ceramic still remains hot and is directly discharged into the environment to cause a heat-energy loss and to make a working atmosphere hot in temperature.

SUMMARY OF THE INVENTION

It is an object of the present invention to provide a far-infrared radiating system which enables an emission of a heat energy produced in a supplied fuel to be decreased so as to make it possible that the heat energy is effectively utilized without making waste.

In the far-infrared radiating system of the present invention, the improvement resides in that: there are employed a plurality of far-infrared radiating units in each of which a combustion-gas passage provided with an inlet and an outlet portions makes a part of its outer peripheral surface adhere to a ceramic which radiates far-infrared rays upon heating and makes other part of the outer peripheral surface be coated with a heat-in sulating material, which inlet portion of the combustion-gas passage is incorporated with a catalytic-combustion unit to construct the far-infrared radiating unit which is connected to a mixing unit for mixing a fuel with an oxygen-containing gas, a fuel-intake portion of which mixing unit is connected to a fuel-feeding line while an oxygen-containing gas intake portion of which mixing unit is connected to the outlet portion of another one of the far-infrared radiating units so that the plurality of the far-infrared radiating units are connected with each other in series; the outlet portion of the far-infrared radiating unit in the final stage of such series-connection of the far-infrared radiating units is connected to a heat exchanger; and, through the heat exchanger, the oxygen-containing gas intake portion of the mixing unit of the far-infrared radiating unit in the first stage of the series-connection is connected to an air-intake pipe, which oxygen-containing gas intake portion of the mixing unit in the first stage acts as a preheated-air intake portion of the mixing unit in the first stage. The air-intake pipe feeds an air under pressure to the heat exchanger which utilizes a waste heat discharged from the final-stage far-infrared radiating unit for preheating the air. The thus preheated air is introduced into the mixing unit of the first-stage far-infrared radiating unit in which the air is mixed with a fuel and burned through the catalytic-combustion unit incorporated in the inlet portion of the first-stage far-infrared radiating unit to produce a combustion gas with a temperature of less than 1000° C., which combustion gas flows into the passage of the first-stage far-infrared radiating unit to make the far-infrared radiating surface of the passage radiate the far-infrared rays. The combustion gas, which has been discharged from the first-stage far-infrared radiating unit and constitutes the oxygen-containing gas, is introduced into the mixing unit of the far-infrared radiating unit in the next stage in which the combustion gas is mixed with an amount of the fuel necessary for increasing the temperature of the combustion gas which has released its heat in the previous stage, i.e., the first stage to lower its temperature to some extent, to such extent. The thus mixed combustion gas is then introduced into the next-stage far-infrared radiating unit and burned again therein to produce a combustion gas the temperature of which is lower than 1000° C., by the use of the catalytic-combustion unit- The thus prepared combustion gas flows into the passage of the far-infrared radiating unit to make a far-infrared radiating surface thereof radiate the far-infrared rays, and after that enters a further next-stage mixing unit. In the same manner as that described in the above, in the following stages, a necessary amount of the fuel is mixed with the combustion gas before its enters the following far-infrared radiating unit, and catalytically burned through the catalytic-combustion unit of the following far-infrared radiating unit to produce the combustion gas which directly flows into the passage of the far-infrared radiating unit to make the far-infrared radiating surface of the passage radiate the far-infrared rays. Finally, the combustion gas discharged from the final-stage far-infrared radiating unit enters the heat exchanger to preheat the air therein, which air is fed from the air-intake pipe.

BRIEF DESCRIPTION OF THE DRAWINGS

The drawings show an embodiment of the present invention, wherein.

DESCRIPTION OF THE PREFERRED EMBODIMENTS

Figure 1:
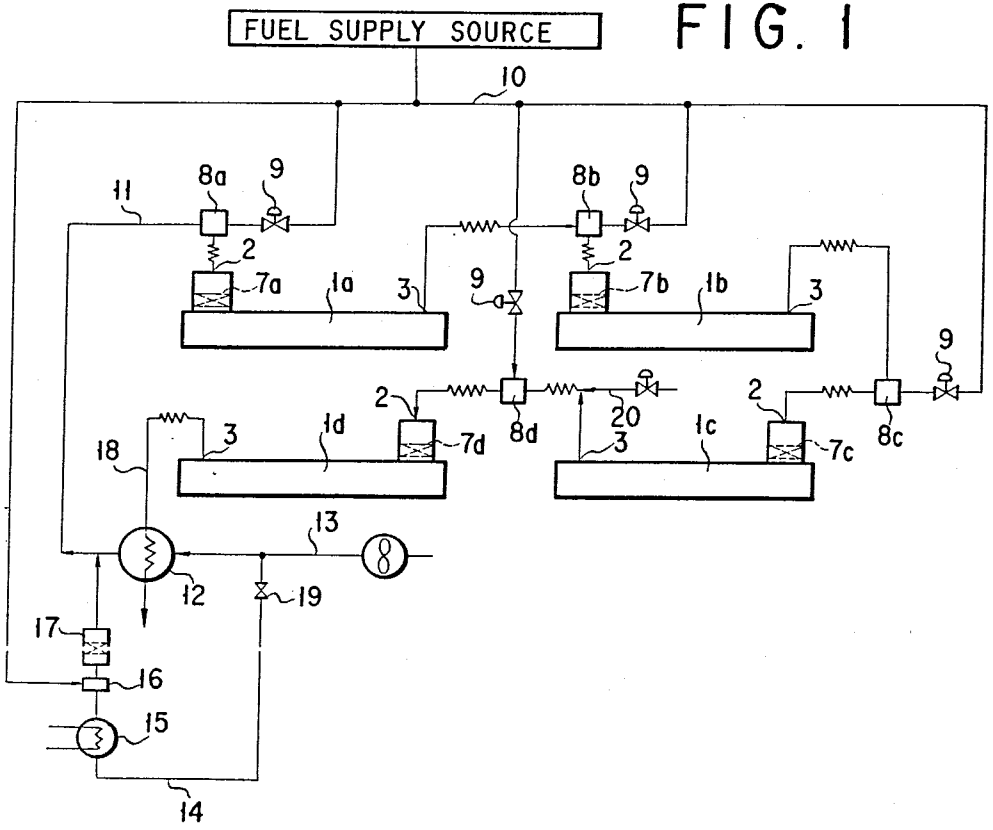
FIG. 1 is a circuit diagram of the embodiment of the far-infrared radiating system of the present invention.

In the drawings: the reference numerals 1*a*, 1*b*, 1*c*, . . . , 1*n* denote far-infrared radiating units; 2 an inlet portion of the far-infrared radiating unit 1*a* and the like; 3 an outlet portion of the far-infrared radiating unit 1*a* and the like; 4 a far-infrared radiating surface of the far-infrared radiating unit 1*a* and the like; 5 a heat-insulating material of the far-infrared radiating unit 1*a* and the like; 6 a fin of the far-infrared radiating unit 1*a* and the like; 7*a*, 7*b*, 7*c*, . . . , 7*n* catalytic-combustion units of the far-infrared radiating units 1*a*, 1*b*, 1*c*, . . . , 1*n*, respectively; 8*a*, 8*b*, 8*c*, . . . , 8*n* mixing units of the far-infrared radiating units 1*a*, 1*b*, 1*c*, . . . , 1*n*, respectively; 10 a fuel-feeding line; 12 a heat exchanger; and 13 an air-intake pipe.

More particularly, the reference numerals 1*a*, 1*b*, 1*c*, . . . , 1*n* denote the first-stage, second-stage, third-stage, . . . , the final-stage far-infrared radiating units (hereinafter simply referred to the radiating units), respectively-Since these radiating units 1*a*, 1*b*, 1*c*, . . . , 1*n* have no difference in construction therebetween, their constructions will be described hereinbelow with reference to that of the radiating unit 1*a*.

Figure 2:
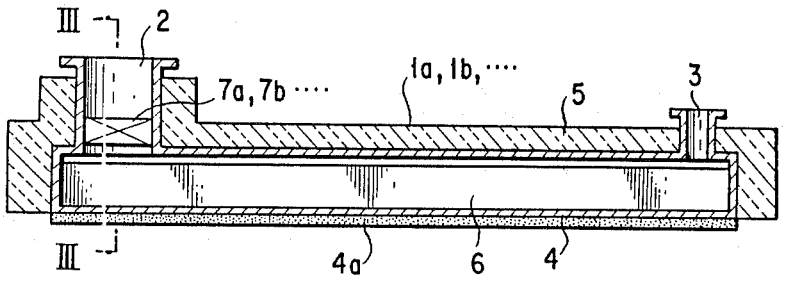
FIG. 2 is a longitudinal sectional view of the far-infrared radiating unit of the system of the present invention.
Figure 3:
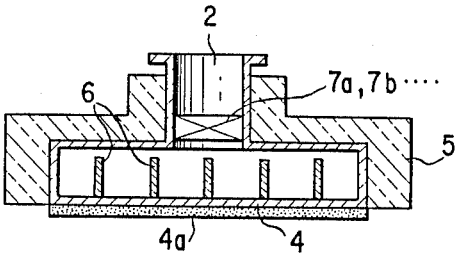
FIG. 3 is a cross sectional view of the far-infrared radiating unit, taken along the line III—III of FIG. 2.

As shown in FIGS. 2 and 3, the radiating unit 1*a* is provided with an inlet portion 2 for receiving an oxygen-containing gas in its one end portion while provided with an outlet portion 3 for discharging a combustion gas in its the other end portion. The radiating unit 1*a* is made of a heat-resisting metal such as a stainless steel and the like and shaped into a box-like configuration having a flat rectangular cross-section. A lower-side surface of the radiating unit 1*a* forms a far-infrared radiating surface 4, while the remaining surface of the radiating unit 1*a* is coated with a heat-insulating material 5. A ceramic 4*a* is adhered to the far-infrared radiating surface 4 by the use of flame-spray coating techniques or suitable application techniques and the like. In addition, fins 6 are provided on an inner surface of the far-infrared radiating surface 4 in a projecting manner.

A catalytic-combustion unit 7*a* is incorporated with the inlet portion 2 of the radiating unit 1*a*. Incidentally, the catalytic-combustion units 7*a*, 7*b*, 7*c*, . . . , 7*n* have no difference in construction therebetween. An inlet portion of the catalytic-combustion unit 7*a* is connected to a mixing unit for mixing a fuel with air, through a flexible pipe. The mixing units 8*a*, 8*b*, 8*c*, . . . , 8*n* have no difference in construction therebetween, and are capable of being incorporated with the radiating units 1*a*, 1*b*, 1*c*, . . . , 1*n* together with the catalytic-combustion units 7*a*, 7*b*, 7*c*, . . . , 7*n*, respectively. A fuel-intake portion of each of the mixing units 8*a*, 8*b*, 8*c*, . . . , 8*n* is connected to a fuel-feeding line 10, through each of flow-control valves 9, respectively. Among the mixing units 8*a*, 8*b*, 8*c*, . . . , 8*n*, the first-stage mixing unit 8*a* makes its air-intake portion be connected to a preheated-air feeding line 11, while the following-stage mixing units 8*b*, 8*c*, . . . , 8*n* make their combustion-gas intake portions be connected to the outlet portions 3 of their previous-stage radiating units 1*a*, 1*b*, 1*c*, . . . , 1*n*, respectively.

The preheated-air feeding line 11 is connected to the air-intake pipe 13 through the heat exchanger 12, which air-intake pipe 13 is connected to an air-feeding apparatus such as a blower and the like. In addition, the preheated-air feeding line 11 is provided with an air-preheating line 14 which by-passes the heat exchanger 12. In the air-preheating line 14 are provided an air-preheating unit 15, a preheating-use mixing unit 16 and a preheating-use catalytic-combustion unit 17. The heat exchanger 12 provided in the preheated-air feeding line 11 is connected to an outlet pipe 18 of the final-stage radiating unit 1*n*, i.e., id in the embodiment shown in FIG. 1 in which the reference numeral 19 denotes a valve for permitting a part of the air fed from the air-intake pipe 13 to flow into the air-preheating line 14.

The far-infrared radiating system having the above construction according to the present invention is operated as follows:

When the system is operated, the valve 19 is operated to allow a part of the air fed from the air-intake pipe 13 to flow into the air-preheating line 14 so that such part of the air is heated in the preheating unit 15 and enters the preheating-use mixing unit 16 in which the air is mixed with fuel and is then burned in the preheating-use catalytic-combustion unit 17 to produce a combustion gas a temperature of which is approximately 1000° C. The thus prepared combustion gas is then mixed with the air fed from the air-intake pipe 13 in the preheated-air feeding line 11 to be decreased in temperature to approximately 300° C. and fed to the first-stage mixing unit 8*a*. Incidentally, in the embodiment shown in FIG. 1, the catalytic-combustion unit 17 is employed in the air-preheating line 14. However, it is possible to employ a burner-type combustion unit in place of the catalytic-combustion unit 17.

In the first-stage mixing unit 8*a*, the fuel is mixed with the preheated-air and then burned in the catalytic-combustion unit 7*a* to produce a combustion gas which flows into the first-stage radiating unit 1*a*.

The mixing ratio of the fuel in the mixing unit 8*a* is required to produce the combustion gas having a temperature of less than 1000° C. and to prevent such mixing ratio from falling in the flammmable range or explosion-limit range of the fuel. In case that the fuel is some type of hydrocarbon, for example such as propane gas, since such mixing ratio of the fuel enabling the combustion gas to have a temperature of less than 1000° C. does not fall in the flammable range, there is no fear that an explosion occurs.

In order to prevent a piping for the combustion gas and associated piping of the radiating units 1*a*, 1*b*, 1*c*, . . . , 1*n* from being corroded, and also in order to prolong the service life of the catalytic-combustion unit, it is necessary to keep the combustion gas at a temperature of less than 1000° C. In a high-temperature atmosphere, the allowable-tensile stress of the above piping is extremely lowered to lead to a structural defect in strength of the piping and excessive oxidative-wastage of the same so as to shorten the service life of the system of the present invention, even if such piping is made of a high-grade heat-resisting steel.

Incidentally, in case that a 400° C.-preheated air is mixed with 0.63% by volume of propane gas and then burned by the use of a catalyst, a combustion gas thus produced has a temperature of 800° C.

When the combustion gas flows through the first-stage radiating unit 1*a*, the far-infrared radiating surface 4 of the radiating unit 1*a* radiates the far-infrared rays, so that the combustion gas releases a certain amount of the heat energy to decrease its temperature to the extent of the equivalent of such released amount of the heat energy in the radiating unit 1*a*, and is then discharged from the radiating unit 1*a* from its outlet 3. At this time, when a temperature of a surface of the ceramic 4*a* adhering to the far-infrared radiating surface 4 of the radiating unit 1*a* is increased to a higher temperature, for example, to approximately 650° C., a radiant-heat energy radiated from the surface of the ceramic 4*a* increases, which means that the difference in temperature between the combustion gas and a metal surface inside the radiating unit 1*a* increases to make it possible that more amount of the heat energy is transferred from the combustion gas to the radiating surface 4 of the radiating unit 1*a*. For example such as the above case, in order to increase the temperature of the surface of the ceramic 4*a* constituting the radiating surface to 650° C., it is necessary to considerably increase the temperature of the combustion gas since the heat-transfer coefficient in boundary-film can not be increased to a large extent even when the flow speed of the combustion gas is considerably increased inside the radiating unit 1*a*, to lead to a difference of 150° to 200° C. in temperature between the combustion gas and the metal surface.

Incidentally, since the fins 6 are provided in an inner surface of the radiating surface 4 of the radiating unit 1*a*, the heat-transfer area for transferring the heat from the combustion gas to the radiating surface 4 is increased to improve the thermal efficiency of the radiating unit 1*a*. In addition, since the remaining outer peripheral surface of the radiating unit 1*a* is coated with the heat-insulating material 5, such remaining outer peripheral surface of the radiating unit 1*a* is heated to by the combustion gas to a temperature considerably close to the temperature of the combustion gas so that the heat energy radiated from the inner surface of such remaining outer peripheral surface of the radiating unit 1*a* is absorbed by an inner surface of the far-infrared radiating surface 4 of the same 1*a*, which radiating surface 4 is positioned under the remaining outer peripheral surface of the radiating unit 1*a*, to make it possible to reinforce the heat-transferring action of the combustion gas to the radiating surface 4 of the radiating unit 1*a*.

The combustion gas issued from the outlet outlet portion 3 of the first-stage radiating unit 1*a* is mixed with the fuel in the second-stage mixing unit 8*b* and then enters the second-stage catalytic-combustion unit 7*b* to be burned therein, so that the temperature of the combustion gas having been decreased in the first-stage radiating unit 1*a* is again increased. The amount of the fuel mixed with the combustion gas in the second-stage mixing unit 8*b* is the equivalent of the heat energy having been released in the previousor first-stage radiating unit 1*a*.

The combustion gas having thus recovered its previous temperature flows into the second-stage radiating unit 1*b* and thereafter repeats the same action as that conducted in the previous- or first-stage radiating unit 1*a* described in the above, so that, after the far-infrared rays are radiated from the radiating surface 4 of the second-stage radiating unit 1*b*, the combustion gas is issued from the outlet portion 3 of the second-stage radiating unit 1*b* and flows into the mixing unit 8*c* of the following radiating unit 1*c*. Then, the combustion gas is mixed with a newly fed fuel in the mixing unit 8*c* and enters the catalytic-combustion unit 7*c* to be burned therein, so that the combustion gas recovers its previous temperature and flows into the third-stage radiating unit 1*c*.

Thereafter, the combustion gas sequentially recovers its previous temperature before it enters the following radiating unit into which the combustion gas having thus recovered its previous temperature flows and releases its heat energy therein as in the form of the far-infrared rays. Finally, when the combustion gas having issued from the final-stage radiating unit 1*n*, i.e., 1*d* in the embodiment shown in FIG. 1 enters the heat exchanger 12, exchanger 12 is energized. Consequently, the fuel supply to the preheating-use mixing unit 16 is cut off and the preheating unit 15 stops its operation, while the bypass air to be fed to the air-preheating line 14 stops its supply, because thereafter the heat exchanger 12 thus energized makes it possible to feed the preheated air to the preheated-air feeding line 11.

The ceramic 4*a*, which adheres to the radiating surface 4 of each of the radiating units 1*a*, 1*b*, 1*c*, . . . , 1*n* and is employed as a far-infrared radiating element, is a sintered product made of mainly metallic oxides such as $SiO_2$, $TiO_2$, $Al_2O_3$, $ZrO_2$, $Fe_2O_3$, $Mn_3O_4$, $K_2O$ and the like which are mixed with each other and sintered to prepare such sintered product.

A wave-length $\lambda_{max}$ of the maximum radiant energy of the infrared rays emitted from the heated ceramic and the like is defined by the following equation:

$$\lambda_{max}=2898/K$$

In case that the surface temperature of the heated ceramic and the like is 650° C. (923° K.), the wave-length of the maximum radiant energy of the infrared rays emitted from the heated ceramic and the like is 3.14 μm.

An object of the far-infrared rays in use is mainly to dry and heat and article. In case that the article is a food, since the food mainly consists of water, the most effective temperature of the ceramic is approximately 632° C., because a far-infrared ray having a wave-length of 3.2 μm can most activate a molecule of water open absorption. Consequently, it is most advantageous to pass the combustion gas having a temperature of less than 1000° C. through the passage of each of the far-infrared radiating units 1*a*, 1*b*, 1*c*, . . . , 1*n*.

The temperature of the combustion gas passing through the passage of each of the radiating units 1*a*, 1*b*, 1*c*, . . . , 1*n* is contolled in each of the catalytic-combustion units 7*a*, 7*b*, 7*c*, . . . , 7*n* to make it possible to change the wave-length of the far-infrared ray radiated from each of the radiating units 1*a*, 1*b*, 1*c*, . . . , 1*n* at will.

In the operation described above, the air fed from the preheated-air feeding line 11 is sequentially employed in each of combustion operation of the fuel conducted sequentially in each of the catalytic-combustion units 7*a*, 7*b*, 7*c*, . . . , 7*n* of the radiating units 1*a*, 1*b*, 1*c*, . . . , 1*n* in the following stages, in a repeating manner until it is discharged from the final-stage radiating unit 1*n*, i.e., 1*d* in the in the embodiment shown in FIG. 1, so that such air fed from the preheated-air feeding line 11 is repeatedly utilized until the oxygen contained in the air decreases to the extent of less than 3%.

For example, in case that propane gas is employed as the fuel with a 100 $Nm^3$-preheated air to obtain a temperature of 800° C. of the combustion gas, an amount of oxygen consumed in the first-stage combustion operation reaches approximately 3.2% and the heat energy of the combustion gas is released by radiation in the form of the far-infrared rays until the temperature of 800° C. of the combustion gas is decreased to 400° C. in the first-stage radiating unit 1*a* for utilizing the thus released heat energy of the combustion gas. In case that the thus utilized combustion gas is mixed with the fuel to be burned again to recover its previous temperature of 800° C., it is possible to use the combustion gas six times in the combustion operations before the residual oxygen of the combustion gas reaches a level of less than 3%. Namely, it is possible to employ six of the far-infrared radiating units 1*a*, 1*b*, 1*c*, . . . , 1*f* connected in series to each other in the system of the present invention without any midway-addition of a fresh air.

In case that such midway-addition of the fresh air is applied, for example as shown in FIG. 1, a fresh-air adding pipe 20 is connected to the fourth-stage mixing unit 7*d* of the fourth-stage radiating unit 1*d* so that the fresh air supplied from the pipe 20 is added to the combustion gas containing the residual oxygen of less than 3%. An amout of the thus added fresh air is the equivalent of the fuel employed to enable the combustion gas to recover its previous temperature of 800° C. By the use of the such midway-addition of the fresh air, it is possible to increase the number of the stages being connected in series countlessly so that the heat generated by combustion of the fuel can be mostly radiated in the form of useful far-infrared rays.

Figure 4:
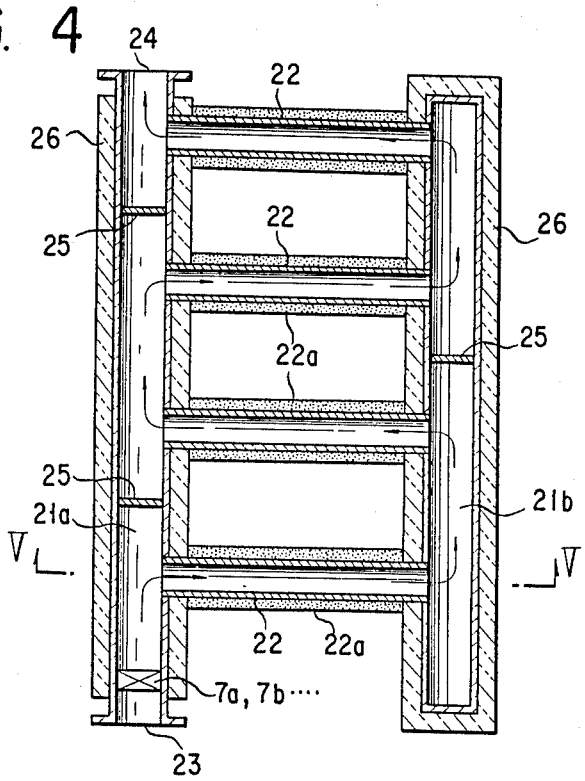
FIG. 4 is a longitudinal sectional view of another embodiment of the far-infrared radiating unit of the system of the present invention.
Figure 5:
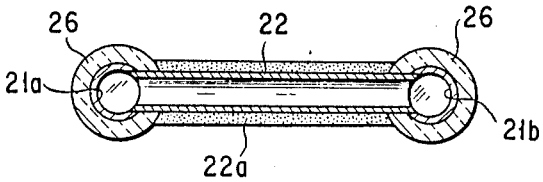
FIG. 5 is a cross sectional view of the another embodiment of the far-infrared radiating unit, taken along the line V—V of FIG. 4.

In FIGS. 4 and 5, there is shown another embodiment of the radiating units 1*a*, 1*b*, 1*c*, . . . , 1*n* which have no difference in construction therebetween, so that they will be hereinbelow desribed in construction with reference to the radiating unit 1*a* shown in FIGS. 4 and 5. As shown in the drawings, the another embodiment of the radiating unit 1*a* is provided with a pair of combustion-gas main pipes 21*a* and 21*b* spaced apart from each other, between which are provided a plurality of radiating pipes 22 which connects the pair of the main pipes 21*a* and 21*b* to each other. A ceramic 22*a* adheres to each of outer surfaces of the radiating pipes 22. One of the main pipes 21*a* and 21*b* is provided with an inlet portion 23 in its one end portion while provided with an outlet portion 24 in the other end portion thereof. Also provided in both of the main pipes 21*a* and 21*b* are a plurality of baffle-plates for enabling the radiating pipes 22 to be communicated with each other in a labyrinthine manner. An outer periphery of each of the main pipes 21*a* and 21*b* is coated with a heat-insulating material 26. Each of catalytic-combustion units 7*a*, 7*b*, 7*c*, . . . , 7*n* is incorporated with the inlet portion 23 of each of the radiating units 1*a*, 1*b*, 1*c*, . . . , 1*n*.

The combustion gas enters the radiating unit 1*a* through the inlet portion 23 and passes through each of the radiating pipes 22 to release its heat energy in the form of the far-infrared rays, and then is discharged from the outlet portion 24 of the radiating unit 1*a*.

According to the present invention, it is possible to decrease the amount of the heat energy emitted into the environment to make it possible to utilize the heat produced by combustion of the fuel effectively without making waste, so that the availability of the fuel is increased. In addition, since each of the catalytic-combustion units 7*a*, 7*b*, 7*c*, . . . , 7*n* of the far-infrared radiating units 1*a*, 1*b*, 1*c*, . . . , 1*n* is incorporated with each of the inlet portions 2 or 23 of the radiating units 1*a*, 1*b*, 1*c*, . . . , 1*n*, it is possible that the combustion gas flows directly into the passage of each of the radiating units 1*a*, 1*b*, 1*c*, . . . , 1*n* to make it possible to reduce the heat-loss therein and also to make it possible to simplify the connecting portions thereof in construction. These are effects inherent in the present invention.

What is claimed is:

1. A far infrared radiating system comprising:

plural far-infrared radiating units, each unit comprising means for defining a combustion-gas passage having an inlet portion, an outlet portion, and an outer peripheral surface, a ceramic coating adhered to a part of said outer peripheral surface for radiating far-infrared rays upon being heated, heat-insulating material coated on the remainder of said outer peripheral surface, and a catalytic-combustion unit mounted in said inlet portions;

plural mixing units for mixing a fuel with an oxygen-containing gas, each having a fuel intake portion, an oxygen-containing gas intake portion, and a mixed gas outlet, the mixed gas outlet of each mixing unit being connected to the inlet portion of one of the plural far-infrared radiating units;

means for feeding fuel to said fuel intake portions of said plural mixing units which includes a flow-control valve at each fuel intake portion and a fuel-feeding line connected in parallel to said flow-control valves;

means for supplying oxygen-containing gas to said oxygen-containing gas intake portions of said plural mixing units which includes means for series connecting the outlet portion of each far-infrared radiating unit to the oxygen containing gas intake portion of the next downstream mixing unit so that said plural far-infrared radiating units are connected with each other in series with respect to oxygen-containing gas flow, and an air intake pipe connected to the oxygen-containing gas intake portion of the first mixing unit in the series; and means for preheating air in said air intake pipe which includes a heat exchanger connected on one side thereof to said air intake pipe and on the other side to said outlet portion of the final far-infrared radiating unit in the series.

2. The far infrared radiating system as set forth in claim 1, further comprising a fresh-air adding pipe connected to one of the oxygen-containing gas intake portions in which residual oxygen in said oxygen-containing gas reaches a level of less than 3%.

3. The far infrared radiating system as set forth in claim 1, wherein each means for defining a combustion gas passage comprises a pair of combustion-gas main pipes spaced apart from each other, plural radiating pipes connecting said main pipes with each other, and plural baffle plates in said main pipes establishing a labyrinthine path for the combustion gas, said radiating pipes having outer surfaces to which said ceramic is adhered, said main pipes having outer surfaces to which said heat-insulating material is coated, one of said main pipes having said inlet portion at one end thereof and said outlet portion at the other end thereof.

4. The far-infrared radiating system as set forth in claim 1, wherein each means for defining a combustion-gas passage comprises a box-like member having a flat rectangular cross-section, end faces, an upper face, side faces and a lower face, and plural longitudinally extending fins inside said member provided on an inner surface of said lower face; said ceramic is adhered to said lower face; and said heat-insulating material is coated on said upper face, said side faces, and said end faces.

5. The far-infrared radiating system as set forth in claim 1, wherein means for preheating air further includes an air-preheating line by-passing said heat-exchanger, an air-preheating catalytic combustion unit in said air-pre-heating line, and an air-preheating mixing unit in said air-preheating line upstream of said catalytic combustion unit, said fuel-feeding line being connected to said air-preheating mixing unit.

* * * * *